United States Patent [19]

Pierson

[11] 4,290,098

[45] Sep. 15, 1981

[54] RECEPTACLE APPARATUS FOR HOUSING COMPONENTS OF A LIGHTING SYSTEM

[75] Inventor: Karl B. Pierson, Warren, Pa.

[73] Assignee: Betts Machine Company, Warren, Pa.

[21] Appl. No.: 65,428

[22] Filed: Aug. 10, 1979

[51] Int. Cl.[3] ..... F21V 29/00

[52] U.S. Cl. ..... 362/267; 362/61; 362/362

[58] Field of Search ..... 362/61, 267, 335, 341, 362/362; 215/352

[56] References Cited

U.S. PATENT DOCUMENTS

| | | | |
|---|---|---|---|
| 2,707,747 | 5/1955 | DeFrees | 362/267 |
| 3,244,869 | 4/1966 | Buck | 362/335 |
| 4,118,767 | 10/1978 | Urbanek | 362/267 |

*Primary Examiner*—Donald P. Walsh
*Attorney, Agent, or Firm*—Munroe H. Hamilton

[57] ABSTRACT

Components of a lighting system, exemplified by the lighting system utilized in commercial transport vehicles are protectively housed in a receptacle apparatus comprising an enclosure body, open at one side, a closure or cover member arranged to extend into the open side of the enclosure body and O-ring sealing means, retained in an annular channel in the enclosure body, for detachably securing the enclosure body and closure member in sealed relationship. The closure member is constructed at one end with an outer tapered cylindrical flange, a portion of which is located in abutting relation to a circular end wall extending around the open side of the enclosure body. This arrangement defines a prying aperture in which a tool such as a screw driver may be inserted to pry off the closure member when desired.

The closure member is characterized by a tubular extension formed integrally with the tapered cylindrical flange and arranged to project inwardly through the opening in the enclosure body in predetermined spaced relation thereto. The tubular extension is further characterized by an extended annular sealing area and a retaining shoulder which is operable to compressibly force the O-ring in displaced relationship along the extended sealing area when the tubular extension and enclosure are in the predetermined spaced relationship noted.

12 Claims, 11 Drawing Figures

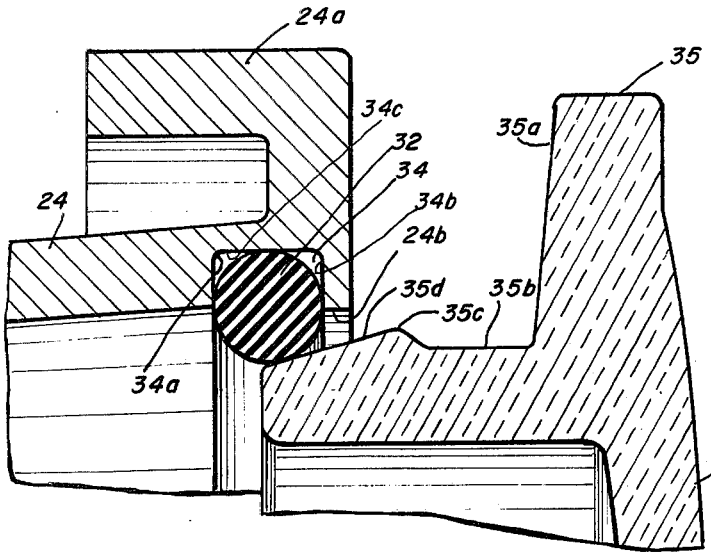
Fig. 4
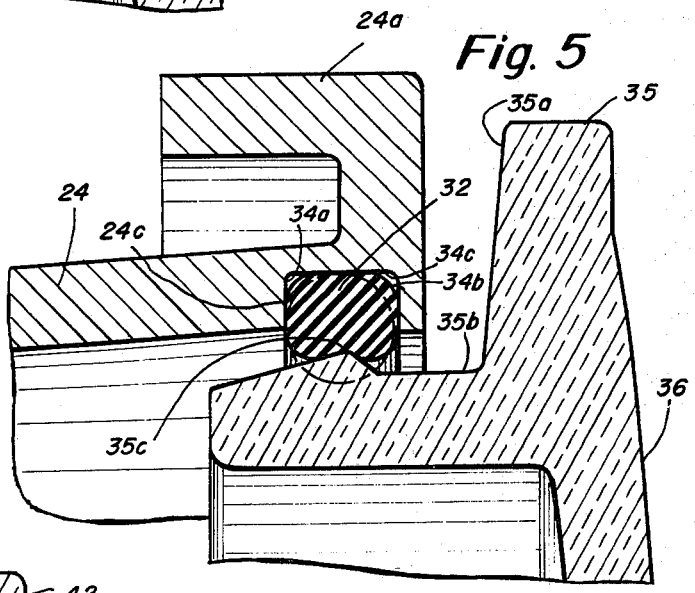
Fig. 5
Fig. 6
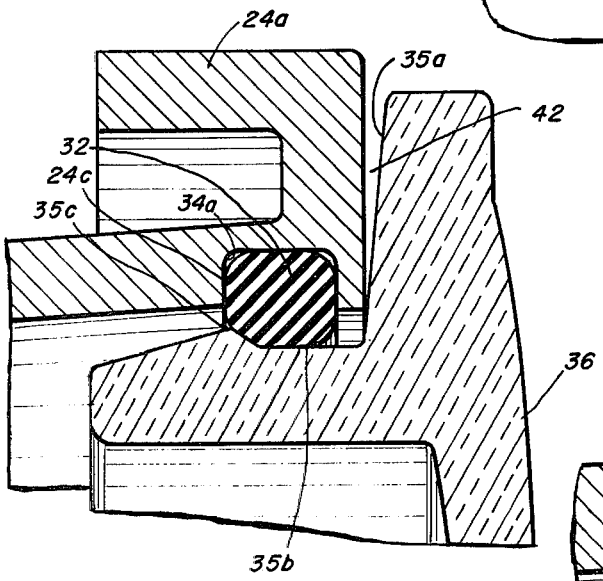
Fig. 7
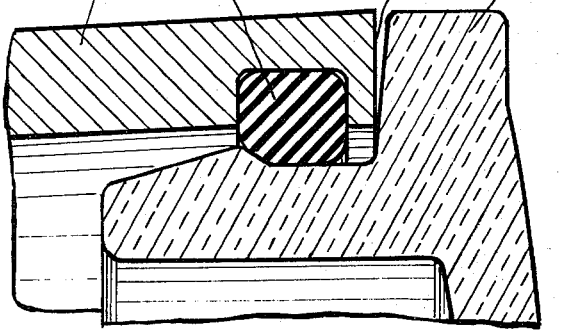

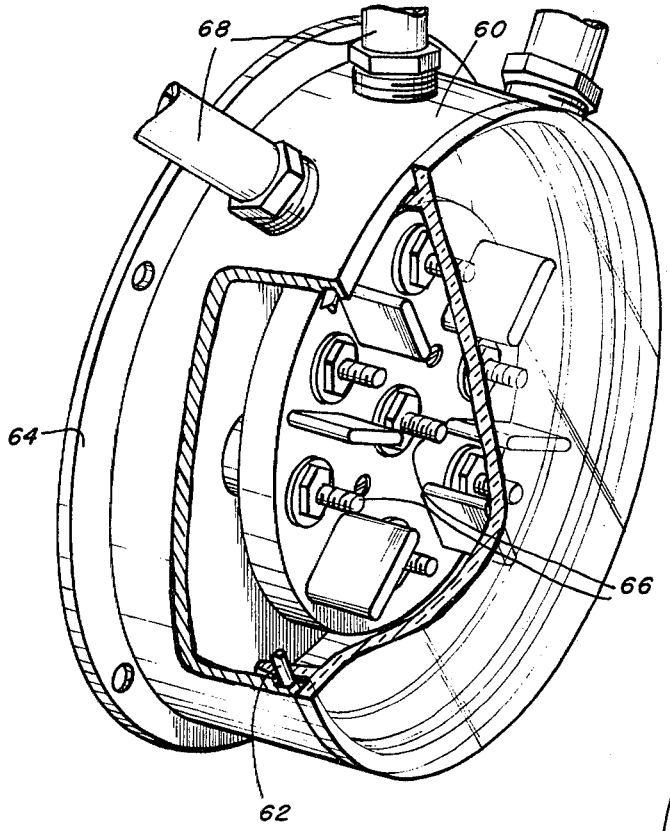
Fig. 8
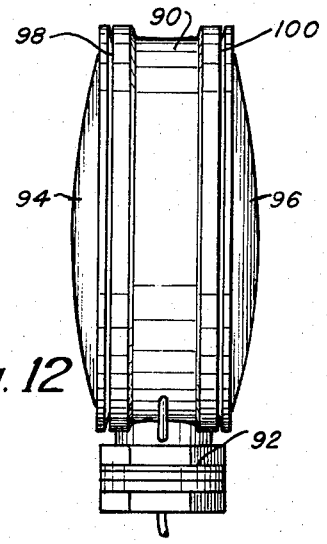
Fig. 12
Fig. 9
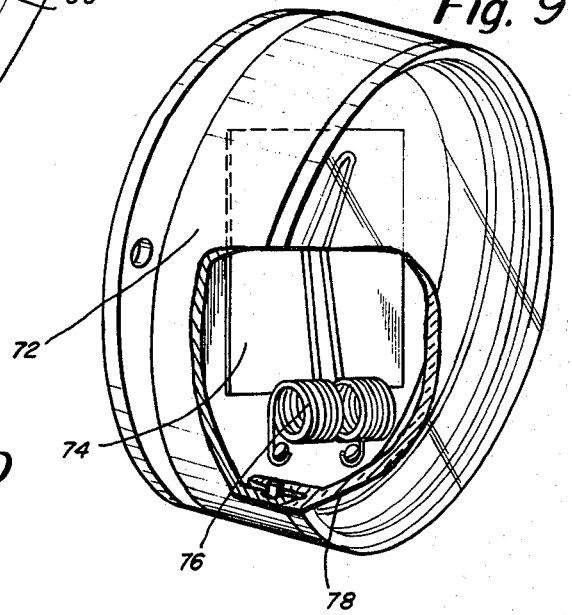
Fig.10
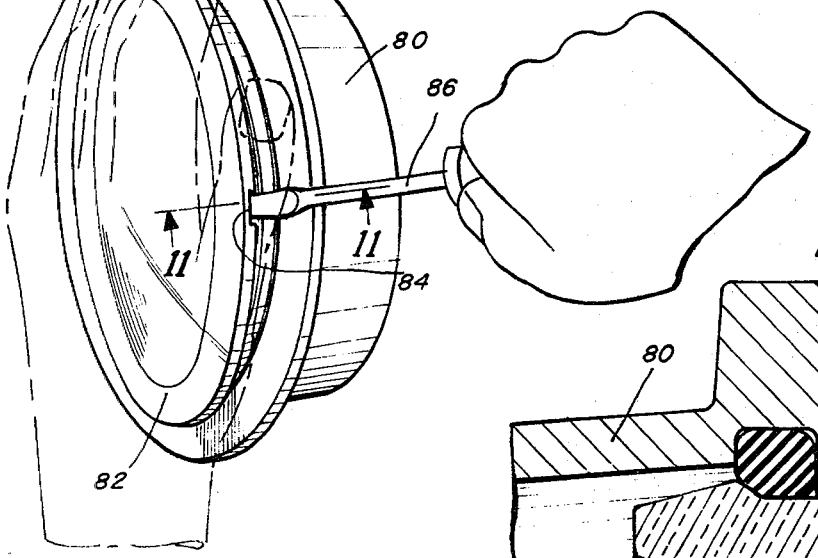
Fig. 11
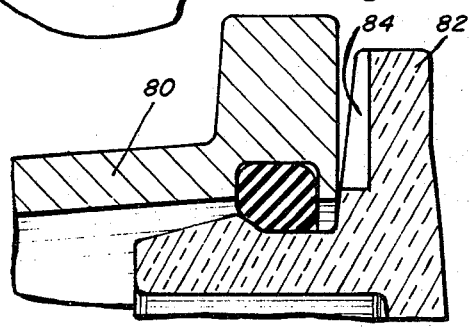

RECEPTACLE APPARATUS FOR HOUSING COMPONENTS OF A LIGHTING SYSTEM

BACKGROUND OF THE INVENTION

This invention relates to receptacle apparatus, and in particular to receptacle apparatus for housing components of lighting systems of the class utilized to equip commercial vehicles such as trucks, trailers, buses and the like. Such equipment must comply with legal regulations covering inter-state and intra-state traffic and includes lighting means of both the marker and clearance types to be mounted at sides and ends of a vehicle. In each type it is customary to employ enclosure bodies having readily detachable closure means to constitute lamp assemblies, junction boxes for receiving electrical wiring and terminals, as well as holder means in which certificates and other printed matter may be visibly contained and in some cases illuminated.

In the normal operating life of a commercial vehicle its lighting system is continuously exposed to road conditions which may necessitate frequent servicing of the components contained in receptacle apparatus. This may include replacement of lamp bulbs, cleaning of lens elements and checking electrical connections and switches. To provide for ready accessibility to components of this nature, the receptacle apparatus must include closure means which is readily detachable. A common practice is provision of an enclosure body around which a closure member is detachably secured by means of an O-ring.

Receptacle apparatus of this general class is well-known in the art as disclosed for example in U.S. Pat. No. 2,707,747. In this patent an O-ring is shown compressibly held between a housing and a lens member with matching grooves which are of circular cross-section. With this sealing arrangement, referred to as a static seal, the extent to which the O-ring may be compressed is limited by the grooves of circular cross-section and the sealing effect realized is understood to be not as effective as may be desired under some operating conditions, particularly where relatively large temperature fluctuations are experienced. Careful observance of required dimensional tolerances must be carried out in the manufacture of parts with matching grooves of circular cross-section in order that an adequate sealing effect may be maintained and combined with ready detachability.

In U.S. Pat. No. 3,244,869 greater compression of the O-ring is achieved by using ring-retaining grooves of rectangular cross-section designed to provide additional space into which O-ring portions may be forced. Here also very close tolerances must be observed in manufacture in order for the parts to provide an adequate seal and yet permit rapid "pry-off".

Moreover, both of the sealing arrangements disclosed in the above-noted patents are subject to drop in effectiveness of seal when exposed to temperature fluctuations and especially sharply lowered temperatures, and a need exists for improved sealing and methods of making improved sealing means.

BRIEF DESCRIPTION OF THE INVENTION

The present invention relates to improved lighting systems for use in commercial transport vehicles and in particular to improved receptacle apparatus for housing components of a lighting system wherein periodic servicing of components is required.

An object of the invention is to provide improved receptacle apparatus for sealably containing components of a lighting system.

Another object of the invention is to provide a receptacle apparatus which includes an enclosure body and a closure member wherein the closure member is detachably secured within the enclosure body by means of an O-ring and the O-ring is displaced over a relatively large sealing area.

Another objective is to devise a closure member with increased tolerance of sealing area to provide for greater compression of an O-ring.

A further objective is to provide an O-ring sealing arrangement which maintains its effectiveness when exposed to drop in temperature and yet is readily detached when required.

Still another object is to provide an arrangement of parts which can be manufactured and assembled in an improved manner.

To attain the foregoing objectives as well as other advantages, there has been devised an enclosure body and closure or cap assembly which provides for an O-ring being compressibly displaced over a relatively extended sealing area with greater compression of the O-ring being realized and wider tolerances between the component parts being acceptable. This is accomplished by constructing the closure member with a tubular extension which combines with an extended sealing area a retaining shoulder arranged to compressibly force the O-ring in displaced relationship along the extended sealing. The increased sealing area is utilized without increasing the force required for detaching the closure when necessary.

BRIEF DESCRIPTION OF THE DRAWINGS

FIG. 4 is an enlarged fragmentary view in cross section of the enclosure body, O-ring and closure member of FIG. 3 in a first position of engagement as the closure member is inserted in the enclosure body.

FIG. 5 is a view similar to FIG. 4, but illustrating an intermediate position of engagement.

FIG. 6 is a view similar to FIGS. 4 and 5, but showing the parts in a fully engaged position with one another in sealing relationship.

FIG. 7 is a view similar to FIG. 6, but illustrating an enclosure body without a flange portion adjacent to the closure member.

FIG. 8 is a perspective view partly broken away to show a junction box and electrical components therein.

FIG. 9 is a perspective view partly broken away to show an enclosure body for use in holding printed subject matter.

FIG. 10 is a perspective view of a modified form of enclosure body and closure member in which the closure member is formed with a pry-off slot for receiving a screw driver blade.

FIG. 11 is a detail cross-sectional view of the receptacle parts of FIG. 10 and showing in more detail the slot for receiving a screw driver blade, and FIG. 12 is an elevational view illustrating the sealing means of the invention combined with a signal lamp having a pedestal base.

DETAILED DESCRIPTION OF THE INVENTION

The receptacle apparatus of the invention in general comprises means for protectively housing various components of a sealed lighting system which may include housings for lamps of various classes as well as housings for use where no lamp is utilized. The lamps may be of the clearance or side marker type, or maybe for directional signals, back-up signals, stop and turn signals, and the like. Housing in which no lamps are present may include junction boxes, nose boxes, holders for certificates, and other printed subject matter.

Principal parts of the receptacle apparatus of the invention consist of an enclosure body open at one side, a closure or cover member designed to extend into the open side of the enclosure body and O-ring means retained in an annular channel in the enclosure body for detachably securing the enclosure body and closure member in sealed relationship.

The closure member is constructed at one end with an outer, tapered cylindrical flange, a portion of which is designed to be located in abutting relation to a circular end wall extending around the open side of the enclosure body. This arrangement defines a prying aperture in which a tool such as a screw driver may be inserted to pry off the closure member when desired.

The closure member is characterized by a tubular extension formed integrally with the cylindrical tapered flange and arranged to project inwardly through the opening in the enclosure body in predetermined spaced relationship thereto. The tubular extension is further characterized by an extended annular sealing area. The circumferential dimension of the annular sealing area is gradually increased to form at an intermediate point a relatively rigid retaining shoulder whose circumference is at a maximum at points lying in a plane passing through an inner side wall of the annular channel in which the O-ring is contained when the cylindrical flange of the closure member is in abutting relation to the circular end wall of the enclosure body. When arranged in the position noted, the retaining shoulder compressibly forces the sealing ring against the outer side wall and bottom of the annular channel and displaces portions of the O-ring along the extended annular sealing area of the tubular extension.

Figure 1:
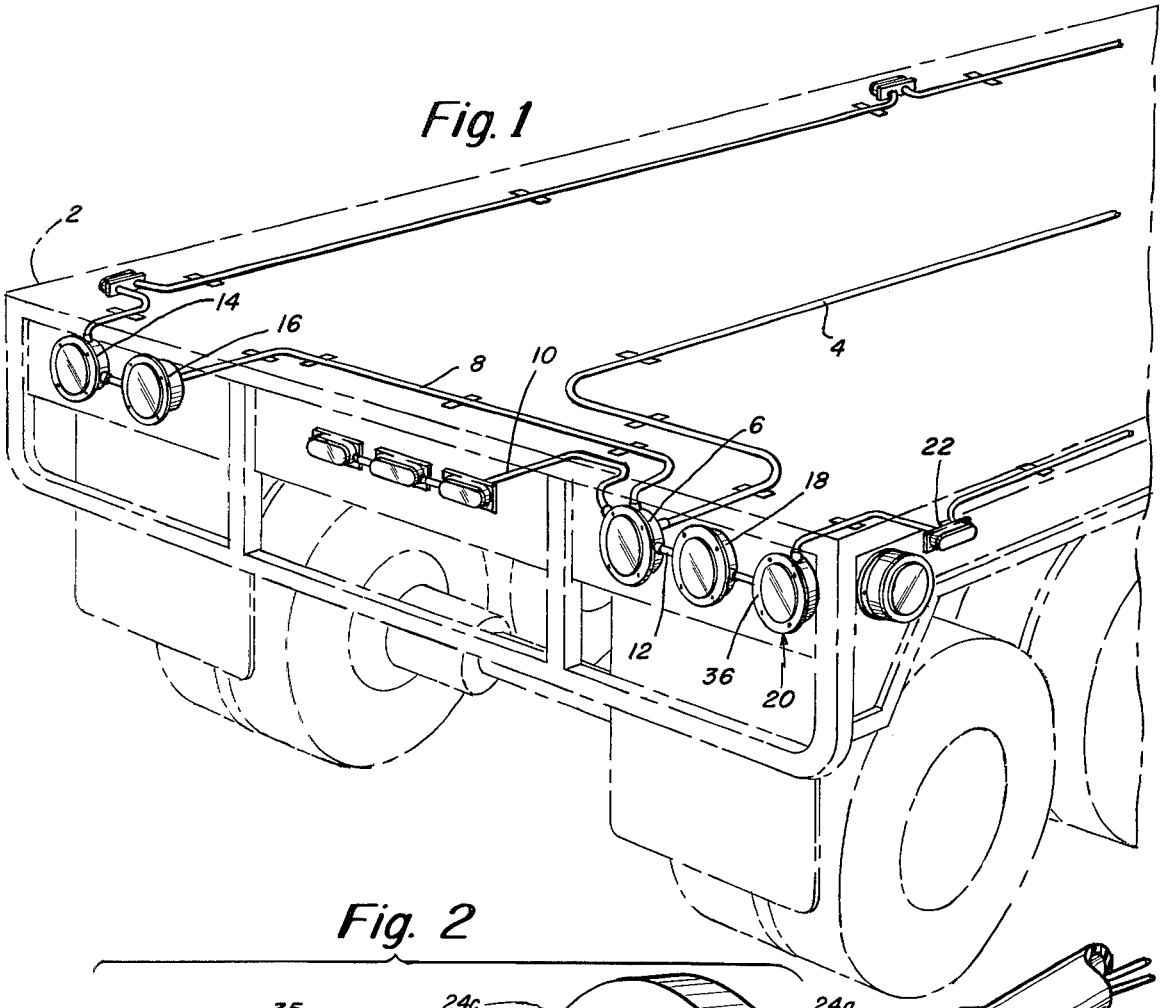
FIG. 1 is a diagrammatic view showing in perspective portions of a truck body indicated by phantom lines and a lighting system illustrated in solid lines on the truck body.

Referring in more detail to the drawings, attention is directed to FIG. 1 in which is illustrated diagrammatically a rear portion of a transport vehicle body 2 indicated in broken lines. Mounted on the vehicle body 2 and shown in solid lines in a lighting system of the class commonly required in transport vehicles. The lighting system indicated in FIG. 1 is intended to be illustrative of a sealed lighting system in which receptacle apparatus of the invention is employed to sealably contain components of the lighting system and in which improved snap seal closure members are readily detachable to provide for servicing operations.

In this sealed lighting system, electrical conductors connect a source of power to a junction box 6. Also connected into the junction box 6 are electrical conductors as 8, 10 and 12 which supply electrical power to a signal lamp indicated by the arrow 20 as well as other lamps denoted by numerals 14, 16, 18 and 22.

Figure 2:
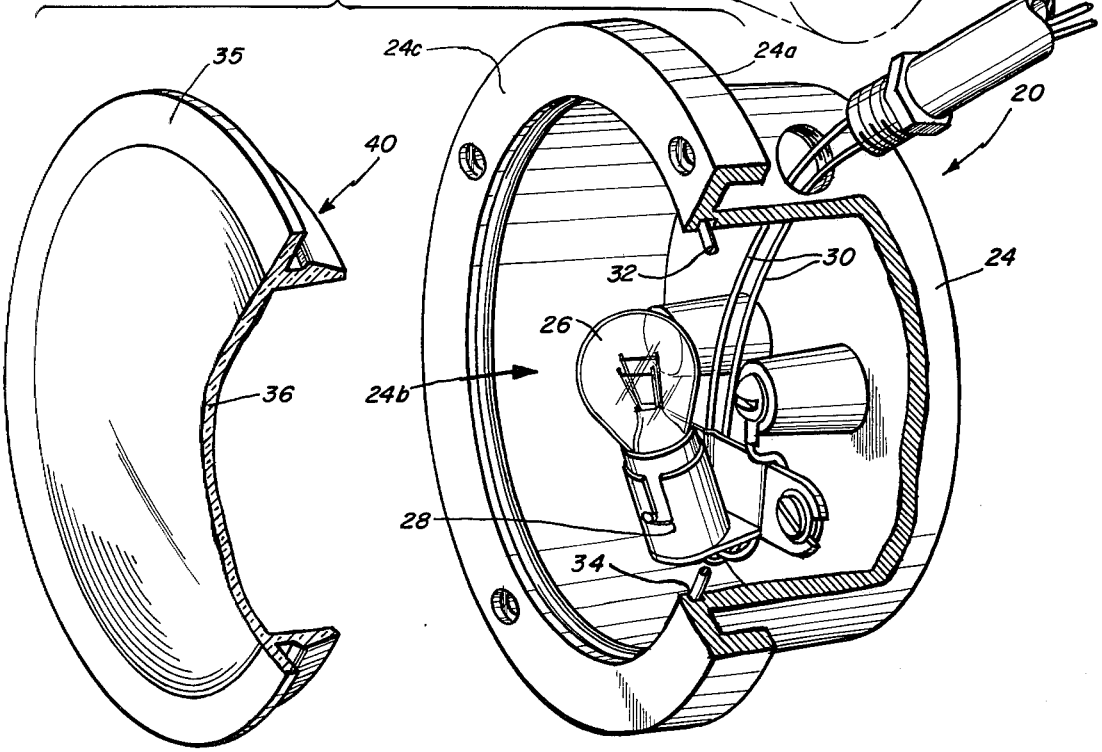
FIG. 2 is an exploded view illustrating in perspective a lamp enclosure body with a transparent closure member removed to show a bulb and wiring system.

The receptacle apparatus of the invention, employed in the sealed system described, is shown in more detail in FIG. 2 wherein the signal lamp denoted by arrow 20 is illustrated with snap seal closure member 36 detached from an enclosure body 24 having an opening **24*b*. Portions of the enclosure body 24 have been broken away to show a bulb 26 and socket 28 of conventional nature and also an O-ring 32 contained in an annular channel 34 formed in a flange portion 24*a*. It will be understood that the flange portion 24*a* illustrates one form of means for attaching a signal lamp to a truck body and presents a circular end wall 24*c* against which the closure member 36 of the invention may be located in abutting relation as shown in FIG. 1** and as hereinafter disclosed in more detail.

In one preferred form of receptacle apparatus of the invention a translucent plastic material may be utilized for both the enclosure body 24 and closure member 36, as suggested by portions shown in cross-section in FIG. 2. It will also be observed that the closure member 36 is, in accordance with the invention, characterized by a cylindrical flange 35 and a tubular extension generally denoted by the arrow 40.

Figure 3:
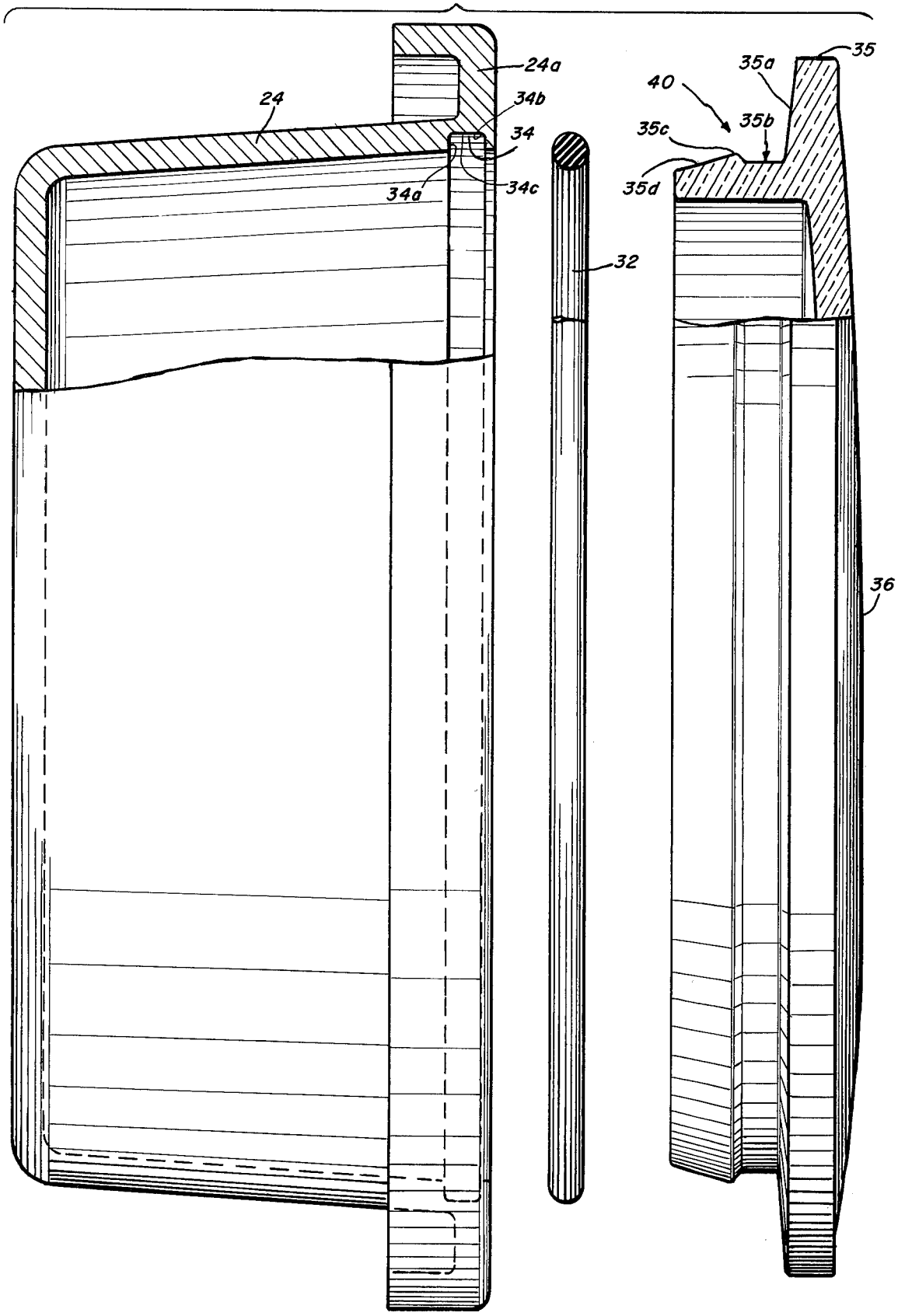
FIG. 3 is a side elevatial view illustrating on a somewhat larger scale the enclosure body illustrated in FIG. 2 and further illustrating the O-ring removed from the enclosure body and the closure member shown detached and partly in cross section.

In FIG. 3 the enclosure body 24, O-ring 32 and closure member 36 are illustrated on a larger scale to show in more detail the annular channel 34 and the configuration of cylindrical flange 35 and its tubular extension 40. As shown in FIG. 3, it will be seen that the channel 34 is formed with an inner side **34*a*, an outer side 34*b* and a bottom side 34*c*, and the O-ring 32 of circular cross-section for example may fit snugly therein as suggested in FIG. 2**.

It will also be noted from an inspection of FIG. 3 that the flange 35 is formed with an inwardly sloping abutment surface **35*a* and the tubular extension 40 is coextensive with the sloping abutment surface 35*a* and the exterior surface of the tubular extension is recessed at 35*b* to provide an extended annular sealing area. The circumferential dimension of this extended annular sealing area 35*b* is gradually increased to form an annular retaining shoulder 35*c* and then decreases to form an inwardly tapered surface 35*d*. It is pointed out that the maximum outer circumference of the retaining shoulder 35*c* is less than the inner circumference of the enclosure body 24, but is greater than the inner circumference of the O-ring 32**.

In assembling the receptacle apparatus of the invention, it will be understood that, with the enclosure body 24 secured to a truck body as shown in FIG. 1, an operator manually inserts the closure member in the opening **24*b*** and then forces the closure member through progressive positions of engagement in the manner disclosed below.

FIG. 4 illustrates the invention parts in a first position of engagement. As will be observed from an inspection of this FIG. 4, the tubular extension is inserted in the opening **24*b* of the enclosure body 24 and the inwardly tapered surface 35*d* comes into contact with the inner periphery of the resilient O-ring 32 and locates the closure in substantially centered relationship to the enclosure body 24**.

FIG. 5 illustrates the invention parts in an intermediate position of engagement in which the retaining shoulder **35*c* has moved against the O-ring 32 and started to displace the O-ring out of its normal circular cross sectional shape into a non-circular cross sectional shape and with displaced portions of the O-ring starting to overlie adjacent surfaces of the retaining shoulder 35***c*.

FIG. 6 illustrates the invention parts in a fully engaged position in which the retaining shoulder 35*c* has its maximum circumference at points lying in a plane passing through the inner wall 34*a* of the annular channel 34 substantially at right angles to the central longitudinal asis of the enclosure body. In this fully engaged position the inwardly sloping abutment surface 35*a* is arranged in abutting relationship with a portion of the circular end wall 24*b* of flange 24 and the retaining shoulder 35*c* has exerted compressive forces which displaces portions of the O-ring 32 against the outer wall 34*b* and bottom 34*c* of annular channel 34 and into contact with the extended annular sealing area at 35*b* to provide a sharply increased sealing effect. It will be noted that in the position of abuttment disclosed there is provided a space 42 in which a tool such as a screw driver blade may be inserted to pry off the closure member when desired.

The receptacle apparatus disclosed above is found to provide important advantages not only in operating performance but also in the manufacture and assembly of units to be sold to the trade. By providing a detachable closure member with a tubular part having an extended annular sealing area and a retaining shoulder, it becomes possible to increase tolerance of spacing of parts and allow for greater compressions of the O-ring. This in turn produces a more effective seal which can be maintained for long operating periods and which is resistant to changes induced by cold temperature. Removal of the closure member is also found to be easier due to less resistance exerted by the retaining shoulder and a positive, water-tight seal may be realized under varying conditions of heat and cold.

In addition to the performance advantages disclosed, it is further found that the improved tolerance allowance provides for molding with less scrap so that cost per piece is less. Also, manufacturing time in inspecting and assembling lamps is reduced and rejection of shipments occurs less frequently.

As earlier noted, the receptacle apparatus of the invention may be employed in various ways. For example, FIG. 7 illustrates a closure member 50 similar to that shown in FIG. 6, but sealably engaged by an O-ring 52 with an enclosure body 54 which does not include a flange portion such as the flange 24*a*. In this arrangement the outer circumference of the enclosure wall may be substantially the same as that of the closure 50 so as to provide a pry-off space 56.

FIG. 8 illustrates use of the receptacle apparatus with a junction box similar to that shown in FIG. 1. As shown in FIG. 8 an enclosure body 60 with O-ring 62 is constructed with a rearwardly disposed mounting flange 64. In this enclosure body may be received terminal posts and electrical conduit means as 66 and 68 respectively. A closure member 70 is sealably engaged by an O-ring 62 and may be made of either a translucent material or an opaque substance.

FIG. 9 illustrates an enclosure body 72 for holding non-electrical components such as certificates 74 and other printed subject matter held by spring clips 76 and sealably contained by means of the closure member 78 of the invention.

FIGS. 10 and 11 illustrate still another modification in which an enclosure body 80 is attached to a closure member of the invention denoted by numeral 82 and having at one side a screw driver slot 84 in which a screw driver 86 may be inserted to expedite detaching the closure when necessary.

In FIG. 12 there is illustrated a receptacle apparatus which is constructed with an enclosure body 90 having pedestal type mounting means 92 for securing the enclosure in a desired position on a vehicle body. Also illustrated in a receptacle apparatus in which two closure members 94 and 96 are located at opposite sides of the enclosure body 90 in abutting relation to circular end walls 98 and 100. The outer diameters of the circular end walls may be of a size corresponding substantially to that of the closure members 94 and 96. This arrangement provides pry-off spaces at both sides of the enclosure body. The enclosure body may house signal lamp bulbs and the closure members 94 and 96 may be of differently colored light-transmitting, plastic material to provide for a double-faced turn signal lamp.

I claim:

1. Receptacle apparatus for use in housing components of lighting systems of the class utilized to equip commercial vehicles such as trucks, trailers, buses and the like, said receptacle apparatus including an enclosure body, means for mounting the enclosure body on a vehicle, said enclosure body having an opening formed at one side thereof and defined by a circular end wall, inner portions of the enclosure body being removed to form an annular channel, a resilient sealing ring contained in the annular channel, a closure member occurring in spaced relation to the circular end wall and presenting an inner side, an outer side and a bottom extending between the inner and outer sides sealably secured to the enclosure body, said closure member having a cylindrical flange section and a tubular extension formed integrally therewith, said tubular extension being engageable with the sealing ring to detachably secure the cylindrical flange section in abutting relation to the circular wall, said tubular extension being further characterized by an extended annular sealing surface, the circumferential dimension of the extended annular sealing surface gradually increasing to form a retaining shoulder whose circumference is at a maximum at points substantially in a plane passing through the said inner side of the annular channel at right angles to the central longitudinal axis of the enclosure body, and the retaining shoulder being arranged to compressibly force the sealing ring against the bottom and outer side of the annular channel in displaced relationship along the said extended annular sealing surface.

2. The invention of claim 1 in which the means for mounting the receptacle apparatus on a vehicle body comprises a mounting flange and the circular end wall forms a part of the mounting flange.

3. The invention of claim 1 in which the mounting means comprises a mounting flange lying in spaced relation to the circular end wall.

4. The invention of claim 1 in which the mounting means comprises a pedestal on which the enclosure body is supported.

5. The invention of claim 1 in which the enclosure body comprises a signal lamp and has a bulb supported thereon and the closure member consists of a light-transmitting plastic material.

6. The invention of claim 1 in which the enclosure body comprises a junction box having labeled terminal posts and the closure member consists of a transparent plastic material occurring in close proximity to the terminal posts.

7. The invention of claim 1 in which the enclosure body comprises a holder for certificates and other vehicle papers and the closure member consists of a transparent plastic material.

8. Receptacle apparatus for housing components of a lighting system of the class utilized to equip commercial tra-sport vehicles such as trucks, trailers, buses and the like, said receptacle apparatus including an enclosure body having an opening formed at one side thereof and presenting a circular end wall, inner portions of the enclosure body being removed to define an annular channel lying in spaced relation to the circular end wall and having a bottom and spaced apart inner and outer sides, a resilient sealing ring seated against the said bottom of the channel and confined between the inner and outer sides of the channel in a position to present an annularly projecting part, a closure member detachably secured to the projecting part of the sealing ring inside the enclosure body, said closure member being formed with an outer cylindrical flange section having an annular abutment surface engaged against the circular end wall, portions of the abutment surface lying in spaced relation to the circular end wall to provide an opening in which a tool may be inserted, a tubular extension formed integrally with the cylndrical flange section and projecting inwardly through the said opening in the enclosure body, inner-most portions of the tubular extension lying in spaced relation to the enclosure opening, the exterior surface of the tubular extension being co-extensive with the abutment surface of the cylindrical section and recessed to provide an extended annular sealing area, the circumferential dimension of the extended annular sealing area gradually increasing to form a relatively rigid retaining shoulder whose circumference is at a maximum at points substantially in a plane passing through the said inner side wall of the annular channel at right angles to the central longitudinal axis of the enclosure body, and said relatively rigid retaining shoulder being arranged to compressibly force the resilient sealing ring against the bottom and outer side of the said channel in displaced relationship along the said extended annular sealing area.

9. Receptacle apparatus for housing components of lighting systems of the class utilized to equip commercial vehicles such as trucks, trailers, buses and the like, said receptacle apparatus including an enclosure body having an opening formed at one side thereof and presenting a circular end wall lying in a plane substantially at right angles to the central longitudinal axis of the enclosure body, inner peripheral portions of the enclosure body being removed to define an annular channel lying in spaced relationship to the circular end wall and having a bottom and spaced apart inner and outer side walls, a resilient sealing ring seated against the said bottom of the channel and confined between the channel sides in a position to present an annularly projecting part, a closure member detachably secured to the sealing ring inside the enclosure body, said closure member being formed with an outer cylindrical section having an annular inwardly sloping abutment surface, portions of said abutment surface of relatively small diameter being arranged in abutting relationship against the circular end wall of the enclosure body and other portions of the said sloping abutment surface of relatively larger diameter occurring in spaced relationship to the said circular end wall to provide an opening in which a prying tool may be inserted, a tubular extension formed integrally with the cylindrical section and projecting inwardly through the said opening in the enclosure body in spaced relationship thereto, the exterior surface of the tubular extension being co-extensive with the said sloping abutment surface of the cylindrical section and recessed to provide an extended annular sealing area, the circumferential dimension of the extended annular sealing area gradually increasing to form a relatively rigid retaining shoulder whose circumference is at a maximum at points lying in a plane passing through the said inner side wall of the annular channel at right angles to the longitudinal axis of the enclosure body, and said relatively rigid retaining shoulder being arranged to compressibly force the sealing ring against the outer side wall and bottom of the said channel in displaced relationship along the said extended annular sealing area.

10. Luminaire apparatus including an enclosure body having an opening formed at one side thereof, a socket centrally located in an opposite side of the enclosure body, a light source mounted in the socket, said enclosure body being formed with an outer annular flange which terminates in a circular end wall lying in a plane substantially at right angles to the central axis of the enclosure body, inner peripheral portions of the annular flange being removed to define an annular channel having a bottom and spaced apart inner and outer side walls, a resilient sealing ring seated against the said bottom of the channel and confined between the channel sides in a position to present an annularly projecting part, a light transmitting closure member detachably secured to the enclosure body, said light transmitting closure member being formed with an outer cylindrical section having an annular inwardly sloping abutment surface, portions of said abutment surface of relatively small diameter being arranged in abutting relationship against the circular end wall of the enclosure body and other portions of the said sloping abutment surface of relatively larger diameter occurring in spaced relation-to the said circular end wall to provide an opening in which a tool may be inserted, a tubular extension formed integrally with the cylindrical section and projecting inwardly through the said opening in the closure body in spaced relation thereto, the exterior surface of the tubular extension being co-extensive with the said sloping abutment surface of the cylindrical section and recessed to provide an extended annular sealing area, the circumferential dimension of the extended annular sealing area gradually increasing to form an annular retaining shoulder whose circumferential dimension is at a maximum at points lying in a place passing through the said inner side wall of the annular channel in the enclosure body, and said retaining shoulder being arranged to compressibly force the sealing ring against the outer side wall and bottom of the channel in displaced relationship along the said extended annular sealing area.

11. Luminaire apparatus including an enclosure body having an opening formed at one side thereof, a socket centrally located in an opposite side of the enclosure body, a light source mounted in the socket, said enclosure body being formed with an outer annular flange which terminates in a circular end wall lying in a plane substantially at right angles to the central axis of the enclosure body, inner peripheral portions of the annular flange being removed to define an annular channel having a bottom and spaced apart inner and outer side walls, a resilient sealing ring seated against the said bottom of the channel and confined between the channel sides in a position to present an annularly projecting part, a light transmitting closure member detachably secured to the enclosure body, said light transmitting closure member being formed with an outer cylindrical section having an annular inwardly sloping abutment surface, portions of said abutment surface of relatively small diameter being arranged in abutting relationship against the circular end wall of the enclosure body and other portions of the said sloping abutment surface of relatively larger diameter occurring in spaced relation to the said circular end wall to provide an opening in which a tool may be inserted, a tubular extension formed integrally with the cylindrical section and projecting inwardly through the said opening in the closure body in spaced relation thereto, the exterior surface of the tubular extension being co-extensive with the said sloping abutment surface of the cylindrical section and recessed to provide an extended annular sealing area, the circumferential dimension of the extended annular sealing area gradually increasing to form an annular retaining shoulder whose circumferential dimension is at a maximum at points lying in plane passing through the said inner side wall of the annular channel in the enclosure body, and said retaining shoulder being of a size and shape for sealably engaging against the sealing ring and exerting compressive forces of an intensity capable of displacing portions of the sealing ring along the said extended annular sealing area of the tubular extension.

12. The invention of claim 11 in which the said annular inwardly sloping abutment surface is formed with screw driver slot means.

* * * * *